US010407941B2

(12) United States Patent
Wagner et al.

(10) Patent No.: US 10,407,941 B2
(45) Date of Patent: Sep. 10, 2019

(54) HANDLE ASSEMBLY FOR ROOF VENTILATOR

(71) Applicants: Barry Wagner, Oklahoma City, OK (US); Benjamin Glenn, Oklahoma City, OK (US)

(72) Inventors: Barry Wagner, Oklahoma City, OK (US); Benjamin Glenn, Oklahoma City, OK (US)

( * ) Notice: Subject to any disclaimer, the term of this patent is extended or adjusted under 35 U.S.C. 154(b) by 0 days.

(21) Appl. No.: 14/676,331

(22) Filed: Apr. 1, 2015

(65) Prior Publication Data

US 2019/0128017 A1 May 2, 2019

Related U.S. Application Data

(60) Provisional application No. 61/973,656, filed on Apr. 1, 2014.

(51) Int. Cl.
*E05B 1/00* (2006.01)
*F24C 15/20* (2006.01)

(52) U.S. Cl.
CPC ..... *E05B 1/0015* (2013.01); *F24C 15/20* (2013.01); *Y10T 16/469* (2015.01); *Y10T 16/4707* (2015.01)

(58) Field of Classification Search
CPC ..... A47J 45/061; A47J 45/063; A47J 45/07; A47J 45/10; Y10T 16/469; Y10T 16/4707; E05B 1/0015
USPC ..... 16/422, 425
See application file for complete search history.

(56) References Cited

U.S. PATENT DOCUMENTS 869,017 A * 10/1907 Pfalzgraf ..... A47J 45/071 220/752
1,176,173 A * 3/1916 Sekula ..... A47J 45/10 294/27.1
1,917,284 A * 7/1933 Young ..... B65D 25/32 220/761
2,092,198 A * 9/1937 Anderson ..... A47J 45/10 126/9 B
2,450,193 A * 9/1948 Galliano ..... A47J 45/10 16/425
2,840,413 A * 6/1958 Beihl ..... A47J 45/10 294/117
3,112,948 A * 12/1963 Burns ..... A47J 45/10 220/759
3,161,430 A * 12/1964 Wiman ..... A47J 45/10 211/88.01
3,262,728 A * 7/1966 Atterbury ..... A47J 45/10 294/16
3,333,882 A * 8/1967 Silverman ..... A47J 45/10 294/33
3,409,935 A * 11/1968 Wishnick ..... A47J 45/10 16/425

(Continued)

*Primary Examiner* — Jeffrey O'Brien
(74) *Attorney, Agent, or Firm* — Warner J. DeLaune; Baker Donelson, et al.

(57) ABSTRACT

A handle assembly for sheet metal lids is provided, comprising a handle member having an upper plate and a grip, and a base member having a pair of brackets formed to engage a corner of the sheet metal lid, and wherein the brackets include an upwardly open groove and a mounting plate. The grooves engage an underside of the lid, wherein the upper plate of the handle member is removably attached to the mounting plates of the base member by a plurality of fasteners.

4 Claims, 3 Drawing Sheets

(56) References Cited

U.S. PATENT DOCUMENTS 4,530,617 A * 7/1985 Hawie ..... A01K 97/14 403/290
4,850,628 A * 7/1989 Rasmussen ..... A47J 45/10 294/33
5,511,285 A * 4/1996 Bush ..... E06C 7/50 16/422
6,092,670 A * 7/2000 Marriott ..... A47J 45/10 210/469
6,382,459 B1 * 5/2002 Liu ..... A47G 19/08 220/719
7,882,596 B2 * 2/2011 Hixon ..... A01B 1/026 16/406
8,276,507 B1 * 10/2012 Walker ..... A47J 27/08 16/110.1
8,540,294 B2 * 9/2013 Dowler ..... B65G 7/12 16/422
9,149,157 B2 * 10/2015 Caplan ..... A47J 45/10
9,155,426 B2 * 10/2015 Corbin ..... A47J 45/10
9,179,795 B1 * 11/2015 Lee ..... A47J 45/061
9,565,973 B2 * 2/2017 Paul ..... A47J 45/071
2004/0093694 A1 * 5/2004 Fourie ..... A47J 45/071 16/422
2004/0174028 A1 * 9/2004 O'Bannon ..... A47J 45/10 294/33
2004/0187265 A1 * 9/2004 Ho ..... A47J 45/10 16/422
2005/0015933 A1 * 1/2005 Hasegawa ..... A47J 45/071 16/422
2005/0217494 A1 * 10/2005 Hrushowy ..... A47J 36/22 99/413
2007/0266526 A1 * 11/2007 Buckingham ..... A47J 45/10 16/425
2008/0006645 A1 * 1/2008 Sup ..... A47J 45/071 220/759
2010/0084370 A1 * 4/2010 Ranzoni ..... A47J 45/061 215/398
2010/0146737 A1 * 6/2010 Kunnath ..... A47B 95/02 16/415
2012/0217252 A1 * 8/2012 Jung ..... A47J 27/002 220/573.4
2015/0108141 A1 * 4/2015 Sullivan, Jr. ..... A47J 45/10 220/573.1
2017/0280940 A1 * 10/2017 Quinn ..... A47J 45/071

* cited by examiner

HANDLE ASSEMBLY FOR ROOF VENTILATOR

CROSS-REFERENCE TO RELATED APPLICATIONS

This nonprovisional application claims the benefit of priority to U.S. provisional application, Ser. No. 61/973,656, filed on Apr. 1, 2014.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

1. Field of the Invention

The invention relates generally to devices and methods used in rooftop ventilator systems, and more particularly to handles that can be retrofitted to such systems to assist in opening the raising the ventilator from the frame.

2. Description of Related Art

In commercial ventilation systems for buildings, larges fans are mounted over vents in a roof. For example, a fan-assisted vent at a restaurant permits an exhaust to be withdrawn from the kitchen. Through this vent, grease and other cooking residue are allowed to leave the building. After a period of use, the vent and the fan become contaminated with grease. Other cooking residue also becomes adhered to the fan blades and other surfaces. Such residue can be flammable and presents a fire hazard, and can also attract undesirable microbes and illness causing bacteria, requiring occasional cleaning.

In most of these systems, a rectangular base rises above the roof vent, and the open base is covered by a rectangular lid. The lid is sometimes referred to as a shoebox lid, because is similar in construction to a cardboard shoebox, but formed from sheet metal. A large hole exists in the lid, and the fan is securely mounted to the lid. Over time the fan becomes dirty and requires cleaning and maintenance. For maintenance purposes, the lid is typically hinged to the base, allowing a worker to raise the lid and rotate the lid and fan assembly away from the base for proper access.

The problem for many workers is that the lid can be difficult to grasp, requiring the worker to lift the edges of the lid with fingers, and then rotate the heavy fan and lid assembly back into a fixed open position. A similar difficulty exists when closing the lid when the work is finished, because the worker must grip the side of the lid and gently allow it to close, being careful not to get his fingers pinched between the lid and the base.

Therefore, there is a need for a device which can be attached to the lid that allows easier and safer opening and closing of the lid when maintenance is required. The device should be simple to install and use, and it should not require any irreversible modifications to the lid itself.

SUMMARY OF THE INVENTION

A handle assembly for sheet metal lids is provided, comprising a handle member having an upper plate and a grip, and a base member having a pair of brackets formed to engage a corner of the sheet metal lid, and wherein the brackets include an upwardly open groove and a mounting plate. The grooves engage an underside of the lid, wherein the upper plate of the handle member is removably attached to the mounting plates of the base member by a plurality of fasteners.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements.

DETAILED DESCRIPTION OF THE INVENTION

The present invention is a non-intrusive handle assembly which serves as a handle for use by workers to open and close the lid and fan assembly on rooftop ventilation systems. In most installations, the handle assembly requires no holes, drilling, tapping or penetration into the lid, and it allows a solid purchase on a shoebox-style lid corner. It can also be removed or reinstalled quickly if the need arises. The handle assembly may also be attached to a flat surface which requires surface penetration if such shoebox-style lid surface is unavailable. It can be produced as a left-hand device and a right-hand device, such that both left and right versions are concurrently installed to provide maximum safety and convenience. It provides additional access points to fasten or penetrate in the event additional fastening or penetration is required for other installations.

Figure 1A:
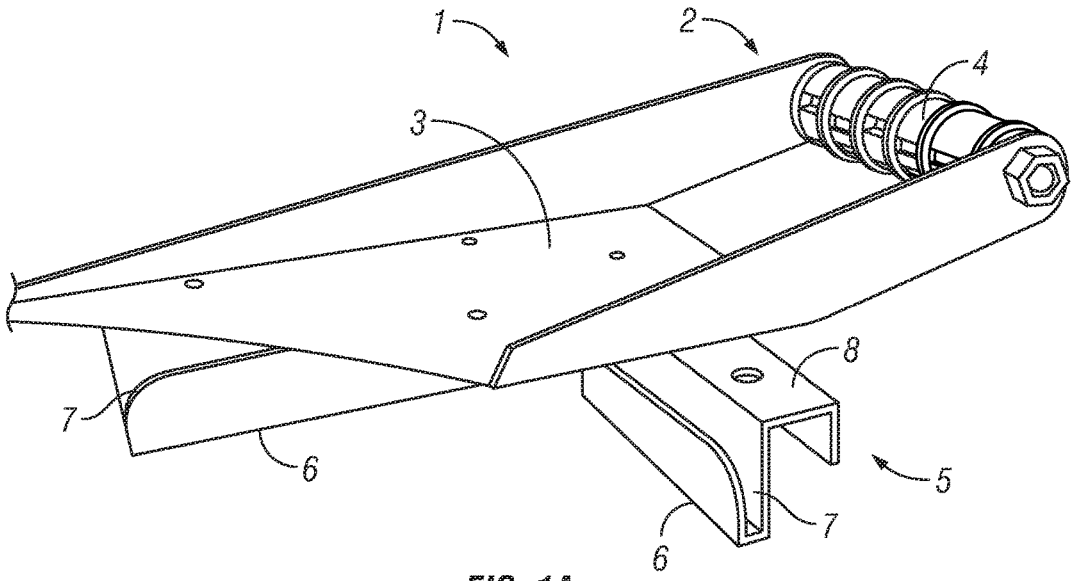
FIG. 1A illustrates a preferred embodiment of a handle assembly of present invention showing the base member and handle member in an assembled orientation.
Figure 1B:
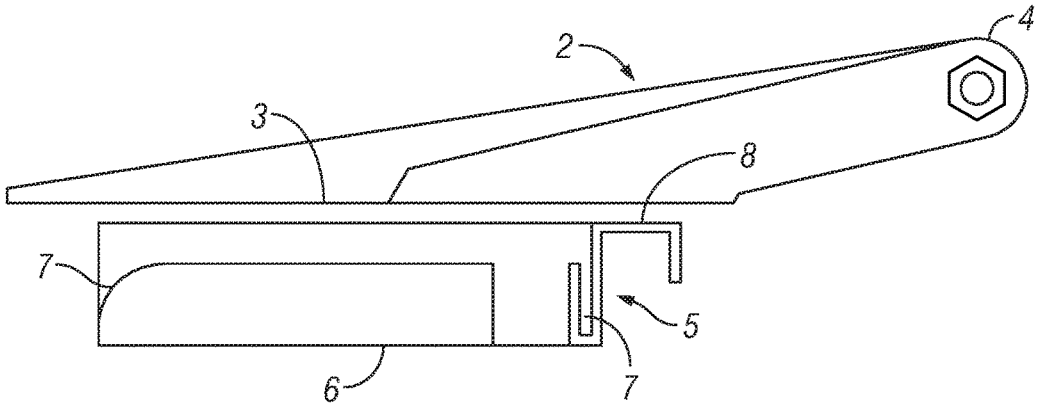
FIG. 1B illustrates an elevation view of the handle assembly of FIG. 1A.
Figure 1C:
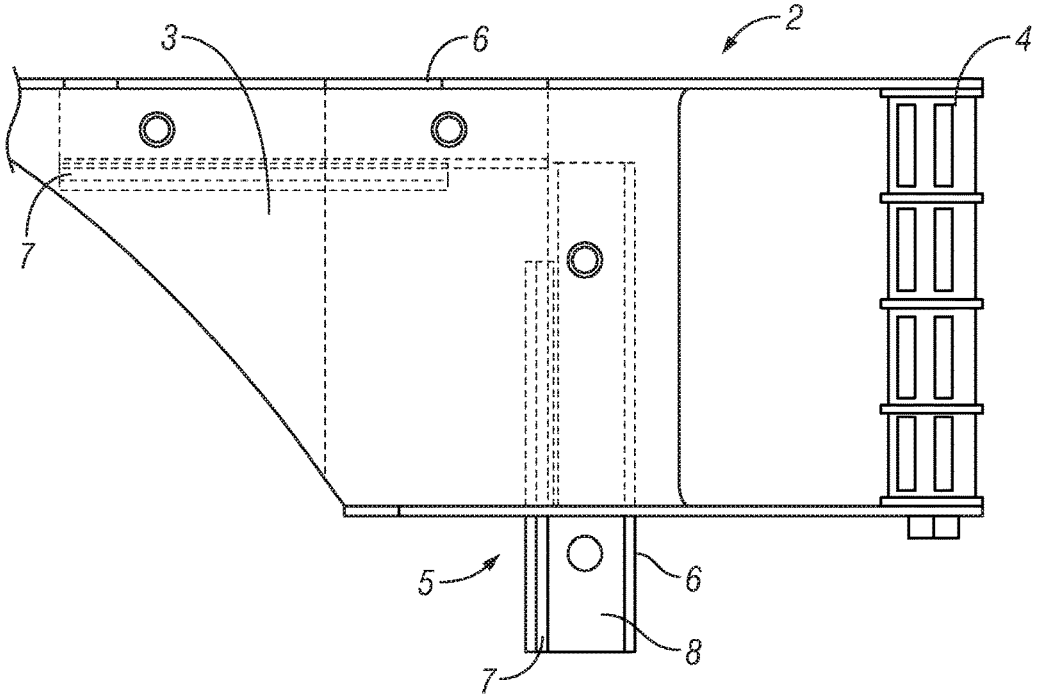
FIG. 1C illustrates a top view of the handle assembly of FIG. 1A.
Figure 2:
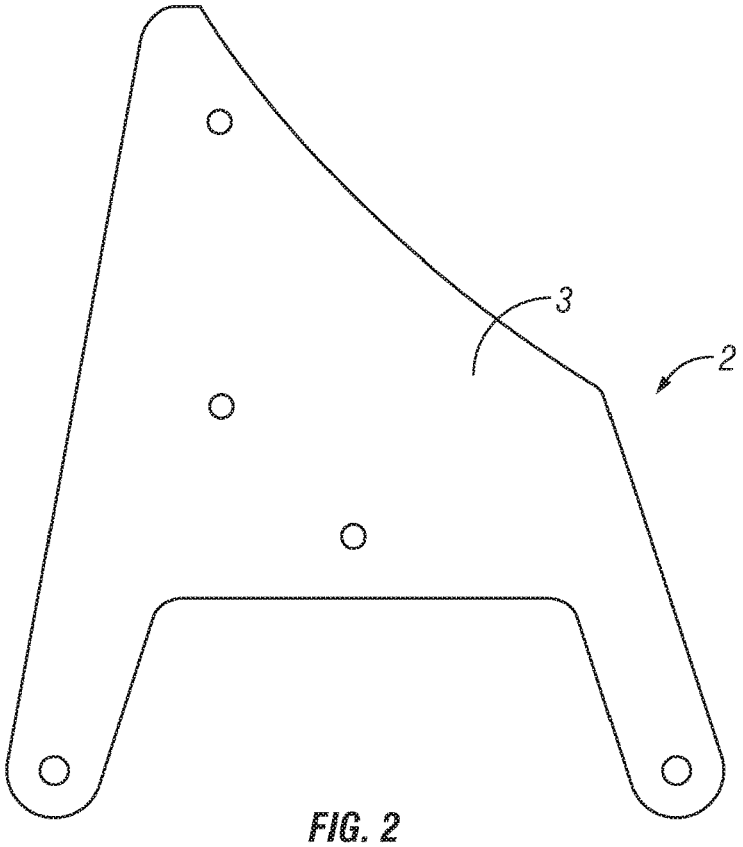
FIG. 2 illustrates the sheet metal form of the handle member prior to bending to its final configuration.
Figure 3:
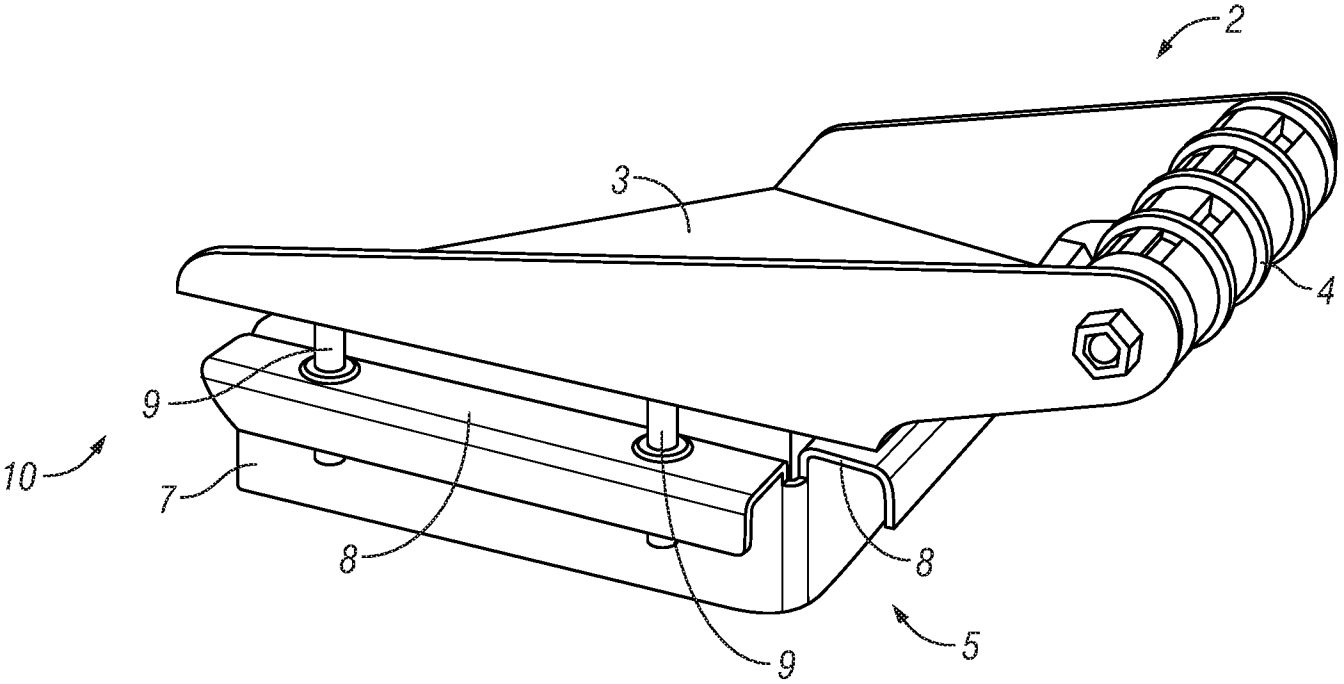
FIG. 3 illustrates a handle assembly having a mirror-image of the handle assembly of FIG. 1 in an installed configuration.

As shown in FIG. 1A, the handle assembly 1 generally comprises a handle member 2 having an upper plate 3 and a grip 4, and a base member 5 having a pair of brackets 6 formed to engage a corner of the sheet metal lid 10. The brackets 6 each include an upwardly open groove 7 and a mounting plate 8. The grooves 7 engage an underside of the lid 10, while the upper plate 3 of the handle member 2 is removably attached to the mounting plates 8 of the base member 5 by a plurality of fasteners 9.

The handle assembly is generally produced from a 16ga cold rolled low carbon steel, although other suitable materials may be used, such as aluminum or plastic. As made of general metal material, the product will be either plasma cut, water jet cut, laser cut, punched or stamped from sheets or rolls of metal although new and better forms of parting the metal may be used at a further date to increase productivity or reduce cost, etc. As made of material other then metal, forming processes common in manufacturing and production will be employed from injection molding, roto-molding, heat formed and or any other production grade forming of the material into the same form and serving the same function as the handle assembly design. Once flat blanks are produced, assuming metal but not limited to metal, the flats blanks will be formed using a press or die and generally powder-coated. If desired per customer request or a design needs, final surfacing may be improved for the product's abilities to combat environmental conditions once in service, or to meet an as of yet undefined characteristic either generally aesthetically pleasing of necessary for the preservation of function in an unforeseen environment.

The unformed handle member 2 is semi triangular and fits inside a rectangle roughly 8.53" by 7.64". It appears with 3 mounting holes and 2 holes for the grip 4. Once formed, the handle member 2 is roughly rectangular and fits inside a rectangle 8.53" by 3.80".

The unformed base member 5 is semi rectangular and fits in a rectangular roughly 10.00" by 3.50". It appears as a notched rectangle with 4 pin holes (to be tapped) and a slit. Once forme, the base member 5 is L-shaped roughly 6.00" by 6.00" by 1.50" tall. It is in this state the J-hook grooves 7 are formed. The grooves 7 slip under the shoe box lid to matingly engage the lid 10.

To affix the handle assembly, the base member 5 is positioned under the lip of the lid 10 corner and moved upward. This step causes the J-hook grooves 7 onto the underside of the lid 10 corner. The handle member 5 is positioned above the base member 5, while lining up the corresponding holes in each part. Fasteners 9, such as bolts that are provided with the handle assembly, are inserted and tightened, causing the handle member 2 and base member 5 to firmly attach to the lid 10. Adjustments for aesthetics and leveling may also be performed at this time.

All references cited in this specification are herein incorporated by reference as though each reference was specifically and individually indicated to be incorporated by reference. The citation of any reference is for its disclosure prior to the filing date and should not be construed as an admission that the present invention is not entitled to antedate such reference by virtue of prior invention.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A handle assembly for sheet metal lids, comprising:

(a) a handle member having an upper plate and a grip; and (b) a base member having a first bracket and a second bracket formed together to engage a corner of the sheet metal lid, and wherein each of the first bracket and the second bracket includes an upwardly open groove and a mounting plate, and wherein the first bracket and the second bracket are orthogonal to one another when the first bracket and the second bracket are attached to the handle member; and wherein the upwardly open groove of each of the first bracket and the second bracket is adapted to engage an underside of the lid, and wherein the upper plate of the handle member is removably attached to the mounting plate of each of the first bracket and the second bracket by a plurality of fasteners.

2. The handle assembly of claim 1, wherein each of the first bracket and the second bracket includes a downwardly depending flange.

3. The handle assembly of claim 1, wherein the grip is offset from the upper plate of the handle member.

4. The handle assembly of claim 1, wherein the first bracket and the second brackets are removably attached to the handle member by a pair of threaded fasteners.

* * * * *